United States Patent [19]

Riegler et al.

[11] 4,072,302

[45] Feb. 7, 1978

[54] TILTABLE METALLURGICAL VESSEL ARRANGEMENT

[75] Inventors: Ernst Riegler, Enns; Manfred Schmidt, Linz, both of Austria

[73] Assignee: Vereinigte Osterreichische Eisen- und Stahlwerke Alpine Montan Aktiengesellschaft, Linz, Austria

[21] Appl. No.: 764,202

[22] Filed: Jan. 31, 1977

[30] Foreign Application Priority Data

Feb. 18, 1976 Austria ..... 1140/76

[51] Int. Cl.[2] ..... C21C 5/46

[52] U.S. Cl. ..... 266/245; 266/91

[58] Field of Search ..... 75/59, 60; 266/91, 99, 266/243, 245, 246, 247; 308/3 R, 3 A, 31, 73

[56] References Cited

U.S. PATENT DOCUMENTS

| | | | |
|---|---|---|---|
| 3,773,497 | 11/1973 | Grenfell et al. | 75/60 |
| 4,023,785 | 5/1977 | Riegler et al. | 266/245 |

*Primary Examiner*—Gerald A. Dost

*Attorney, Agent, or Firm*—Brumbaugh, Graves, Donohue & Raymond

[57] ABSTRACT

A tiltable metallurgical vessel arrangement, in particular a converter for a steel making plant, has carrying trunnions, a fixed bearing, an expansion bearing, bearing housings for the bearings, and force measuring means resting on a supporting construction with bearing housings resting on the force measuring means. Vertical sliding faces provided on each bearing housing and on the supporting construction at both sides of the carrying trunnion axes form guides and counter-guides that engage each other so as to prevent horizontal motion of the bearing housings in the direction of the axes of the carrying trunnions.

6 Claims, 6 Drawing Figures

TILTABLE METALLURGICAL VESSEL ARRANGEMENT

BACKGROUND OF THE INVENTION

The invention relates to a tiltable metallurgical vessel, in particular a converter to be used in a steel making plant, having a fixed bearing and an expansion bearing for the carrying trunnions, wherein the bearing housing is arranged on force measuring means resting on the supporting construction and is guided in vertical guides whose lateral dimension extends parallel to the trunnion axis.

In more recently developed metal production processes, in particular in steel making processes, the weight changes of the materials charged in the vessel are used for controlling the production process. For monitoring the process, curves of the changes of the weight of the bath are plotted. From the paths of these curves conclusions can be drawn on the carbon content of the melt, the temperature of the bath and the tendency towards slopping. Thus, during a heat, a precise weighing of the materials charged and the fluxing agents is of great importance.

For carrying out such a weighing it has been known to mount the bearing housings directly, or via bridges, on force measuring means. It is a pre-requisite for an exact weighing that only vertical forces act on the force measuring means, since transverse forces falsify the measuring result or make it inaccurate. For this reason, care must be taken that the transverse forces are accommodated by separate construction elements. Thus, for instance, the bearing housings of the carrying trunnions have been guided in the vertical direction by rollers in a force-measuring-means-containing recess of the support. (British Pat. No. 1,373,652). In another arrangement an intermediate plate having a thickness of between 25 and 60 mm has been arranged between the bearing housing and the supporting construction, which plate has accommodated all the forces of the expansion bearing displacement, the skull pushing and the converter operation. Furthermore it has been known to hinge the bearing housings or bridges resting on the force measuring means, to the supporting construction by guide rods or tension members arranged in horizontal direction.

The known arrangements, in particular those having horizontal guide rods, are complicated structures and require a lot of space, so that it is very difficult to additionally install force measuring means into already existing converter plants. The known arrangement with the roller guide has the disadvantage that no area contact, but only a linear contact is present between the bearing housing and the supporting construction, and that the forces which occur are correspondingly strong, whereby the rollers are easily jammed. Consequently, the load acting on the force measuring means is not uniform and the measuring result is falsified. Furthermore, these rollers act only in a horizontal direction perpendicular to the axes of the trunnions. Horizontal forces in all other directions cannot be transmitted by the rollers to the supporting construction.

SUMMARY OF THE INVENTION

The invention aims at avoiding these disadvantages and difficulties and has as its object to provide a robust and simple vertical guide for the bearing housing of a converter having force measuring means, wherein all the horizontal forces that occur are accommodated and kept away from the force measuring means.

According to the invention, this object is achieved in that vertical sliding forces are providing on the bearing housing and on the supporting construction at both sides of the axes of the carrying trunnions, which faces engage each other as guides and counter-guides so as to prevent horizontal motion of the bearing housings in the direction of the axes of the carrying trunnions.

It is advantageous, if the sliding faces on the bearing housing and on the supporting construction are both in the axial direction of the carrying trunnions and perpendicular to the axial direction of the carrying trunnions and are each directed towards each other in pairs.

According to a preferred embodiment, a guide is designed as a rail and the pertaining counter-guide is designed as a counter-rail embracing the rail in a U-like manner.

It is an advantage if the sliding faces are formed of plastic inlays having high sliding properties, in particular polytetrafluoroethylene inlays.

For eliminating play created by wear or because of production faults, which play interferes with a precise weighing, the guide and counter-guide at one side of the carrying trunnion are adjustable relative to the guide and counter-guide at the other side of the carrying trunnion.

BRIEF DESCRIPTION OF THE DRAWINGS

The invention shall now be described by way of a number of embodiments and with reference to the accompanying drawings, wherein.

DESCRIPTION OF EXEMPLARY EMBODIMENTS

Figure 1:
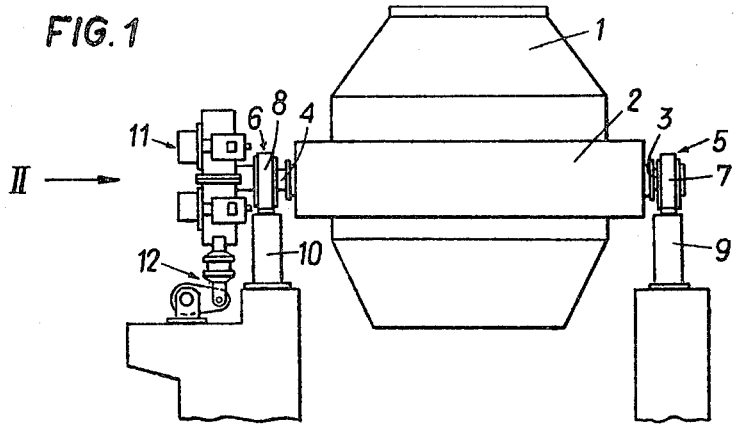
FIG. 1 shows the overall arrangement of a converter plant in front view.

In FIG. 1, a converter of a steel making plant is denoted by 1, which converter is inserted in a carrying ring 2 having two carrying trunnions 3 and 4. The carrying trunnions are mounted in one expansion bearing 5 and one fixed bearing 6, whose bearing housing 7 and 8 rest on one supporting construction each. The supporting construction comprises a support 9 or 10, respectively, stationarily connected to the base. The carrying trunnion 4 allocated to the fixed bearing is connected with a tilting drive 11, which tilting drive is supported on the base via a torque support 12.

Figure 2:
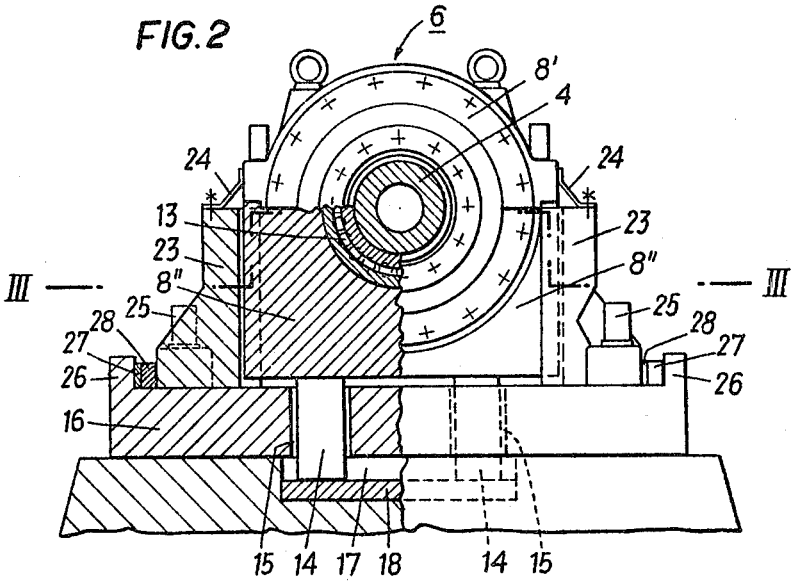
FIG. 2 is a view of a carrying trunnion bearing in the direction of the arrow II of FIG. 1 on an enlarged scale, partly in section, and without the converter drive.
Figure 3:
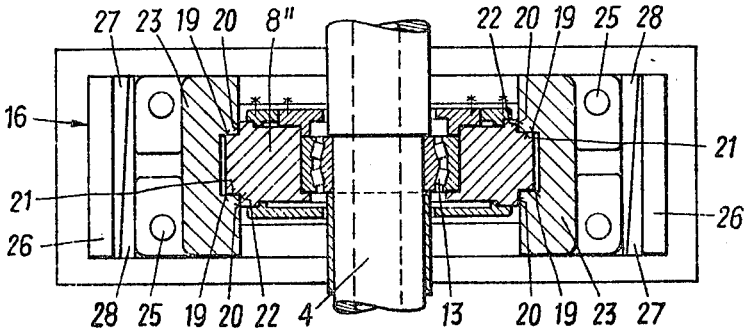
FIG. 3 illustrates a section along line III-III of FIG. 2, and FIGS. 4*a* to 4*c* show various embodiments of the sliding faces in a manner analogous to FIG. 3, but on an enlarged scale.

FIGS. 2 and 3 illustrate the construction of the fixed bearing 6 and its arrangement on the support 10. The expansion bearing is designed in the same manner and arranged on the stand 9. The bearing housing 8 of the fixed bearing is assambled of the bearing housing upper part 8' and the bearing housing lower part 8'', into which a pendulum roller bearing 13 accommodating the carrying trunnion 4, is inserted. Also other bearing insets, such as a slide bearing inset, can accommodate the carrying trunnion.

The bearing housing lower part 8'' rests on two force measuring means 14 symmetrically arranged with respect to the axis of the carrying trunnion. These force measuring means penetrate one bore 15 each of a sole plate 16 arranged between the bearing housing lower part 8″ and the support 10. The support is provided with a recess 17 into which a plate 18 is inserted and on which the force measuring means 14 rest.

The bearing housing lower part is provided with vertical sliding faces 19 and 20 on both sides of the axis of the carrying trunnion, which sliding faces are in both the axial direction and perpendicular to the axial direction of the carrying trunnion and are arranged opposite each other in pairs. With these sliding faces, the bearing housing lower part contacts counter-sliding faces 21 and 22 of part 23 rigidly connected with the support. The parts 23 which project upwardly laterally of the bearing housing lower part up to approximately the axis of the carrying trunnion and which are covered by protecting plates 24, rest on the sole plate 16 and are secured to the support 10 by screws 25 penetrating the sole plate. The fixed bearing 6 mounted on the supporting construction in this manner thus is vertically displaceable, whereby vertical forces can be transmitted to the force measuring means. Horizontal forces, on the other hand, are transmitted to the support 10 via the sliding faces (19, 20, 21 and 22) and the parts 23, independent of their direction, and can no longer be effective between the bearing housing lower part 8″ and the force measuring means 14 and between the force measuring means 14 and the support 10, respectively.

At the outer side of the parts 23, the sole plate 16 is provided with upwardly projecting noses 26. Between the noses 26 and the parts 23, two wedges (27 and 28) each are inserted. By the mutual displacement of the wedges each one of the two parts 23 can be adjusted to the bearing housing lower part 8″. Thereby, the sliding faces 22 can be adjusted to the sliding faces 20 of the bearing housing lower part 8″ without play.

Figure 4A:
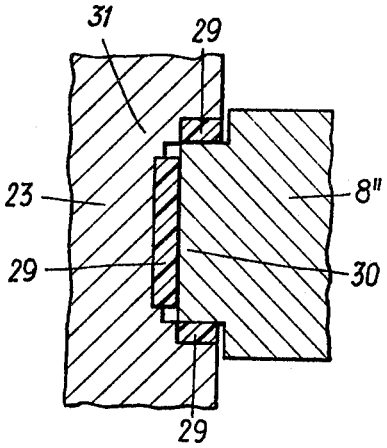
Figure 4C:
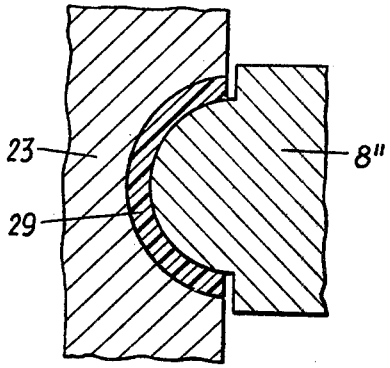
Figure 4B:
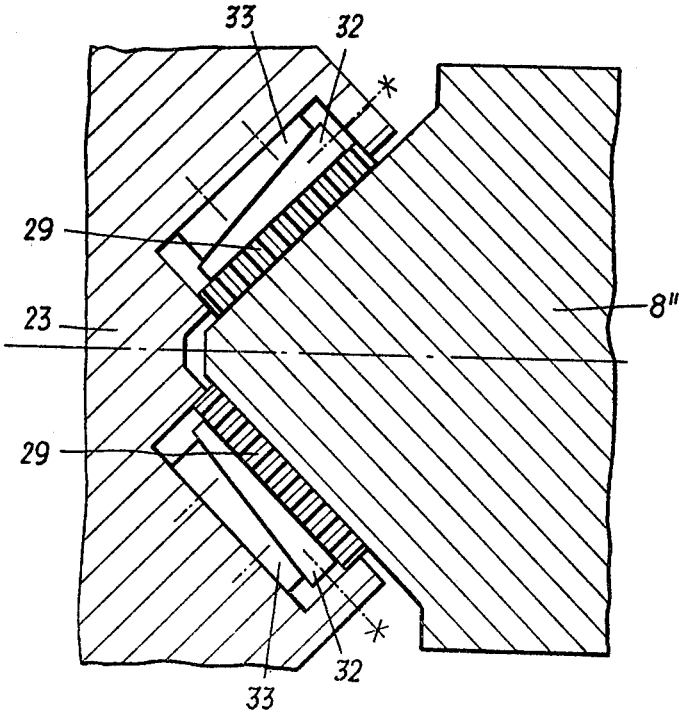

The sliding faces of the parts 23 suitably, as illustrated in FIG. 4*a*, are formed by plastic inlays 29 of polytetrafluoroethylene. Due to the high sliding properties of this plastic material, the friction occurring along the sliding faces is reduced to a minimum during the displacement of the bearing housing lower part 8″. According to FIG. 4*a*, one guide is designed as rail 30, which is embraced in a U-like manner by the pertaining counter-rail 31. The shape of the cross-section formed by the sliding faces and the counter-sliding faces, respectively, must be designed in such a manner that horizontal forces can be accommodated independent of their direction, i.e. they must engage each other so as to prevent horizontal motion of the bearing housings in the direction of the axis of the carrying trunnions 3, 4. Thus, other arrangements of the sliding faces and counter-sliding faces than the ones shown in FIGS. 3 and 4*a* can also be provided. For instance, the sliding faces and the counter-sliding faces can have a triangular cross-section, according to FIG. 4*b*, or also a semi-circular cross-section, according to FIG. 4*c*. Also, a combination of various shapes of cross-sections is possible at both sides of the axes of the carrying trunnions. FIG. 4*b* illustrates a particularly advantageous mounting of the plastic inlays 29 in the part 23. The plastic inlays are displaceable perpendicular to their sliding faces by the wedges 32 and 33, and thus are adjustable relative to the counter-sliding faces of the bearing housing lower part 8″ without play.

What we claim is:

1. In a tiltable metallurgical vessel arrangement, in particular a converter to be used in a steel making plant, of the type including horizontal carrying trunnions for carrying the vessel, a fixed bearing and an expansion bearing accommodating the carrying trunnions, bearing housings in which the fixed bearing and the expansion bearing are arranged, force measuring means for mounting the bearing housings thereon, and a supporting construction, the force measuring means resting on the supporting construction, vertical guide means with their lateral dimension extending parallel to the axes of the carrying trunnions for guiding the bearing housings thereon, the improvement characterized in that the vertical guide means are constituted by vertical sliding faces provided on each bearing housing and on the supporting construction at both sides of the axes of the carrying trunnions so as to form guides and counter-guides engaging each other so as to prevent horizontal movement of the bearing housings in the direction of the axes of the carrying trunnions.

2. A tiltable metallurgical vessel arrangement as set forth in claim 1, wherein the vertical sliding faces one each bearing housing and on the supporting construction extend both in the axial direction of the carrying trunnions and perpendicular to the axial direction of the carrying trunnions and are each directed towards each other in pairs.

3. A tiltable metallurgical vessel arrangement as set forth in claim 1, wherein the guides are designed as rails and the counter-guides pertaining thereto are designed as counter-rails, the counter-rails embracing the rails in a U-like manner.

4. A tiltable metallurgical vessel arrangement as set forth in claim 1, wherein the sliding faces are formed of plastic inlays having low friction, high sliding, properties.

5. A tiltable metallurgical vessel arrangement as set forth in claim 4, wherein said plastic inlays are polytetrafluoroethylene inlays.

6. A tiltable metallurgical vessel arrangement as set forth in claim 1, wherein the guide and counter-guide arranged on one side of a carrying trunnion are adjustable relative to the guide and counter-guide arranged at the other side of that carrying trunnion.

* * * * *

UNITED STATES PATENT OFFICE

CERTIFICATE OF CORRECTION

Patent No. 4,072,302 Dated Feb. 7, 1978

Inventor(s) Riegler et al.

It is certified that error appears in the above-identified patent and that said Letters Patent are hereby corrected as shown below:

Col. 2, line 4, "forces are providing" should be --faces are provided--;

Col. 2, line 50, "housing" should be --housings--;

Col. 4, line 33, "faces one" should be --faces on--.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*